United States Patent [19]

Stone

[11] 4,050,612

[45] Sept. 27, 1977

[54] DISPENSING CONTAINER

[75] Inventor: Thomas Stone, Lisbon, Conn.

[73] Assignee: Jules Silver, Norwich, Conn.

[21] Appl. No.: 689,828

[22] Filed: May 25, 1976

[51] Int. Cl.[2] ..... B67D 5/52

[52] U.S. Cl. ..... 222/135; 128/220; 222/162; 222/386

[58] Field of Search ..... 222/129, 309, 134, 320, 222/321, 137, 319, 145, 385, 160, 162, 386, 386.5, 390–392, 135, 142.5, 136; 128/220, 272

[56] References Cited

U.S. PATENT DOCUMENTS

| | | | |
|---|---|---|---|
| 1,369,595 | 2/1921 | Wood | 222/129 |
| 2,001,819 | 5/1935 | Elle et al. | 222/386 |
| 2,752,072 | 6/1956 | Steele | 222/385 |
| 3,012,695 | 12/1961 | Lerner | 222/129 |
| 3,208,645 | 9/1965 | Raynet | 222/320 |

*Primary Examiner*—Robert B. Reeves
*Assistant Examiner*—H. Grant Skaggs
*Attorney, Agent, or Firm*—John A. Mitchell; Pasquale A. Razzano

[57] ABSTRACT

A dispenser for flowable materials such as creams, includes a pair of open ended containers nested telescopically with each other at their open ends, with the upper container having a dispensing orifice formed therein adjacent its upper end and containing a hollow dispensing channel communicating at one end with at least a portion of the orifice and having its other end located adjacent the open end of the upper container. A piston is received in the upper container for sliding movement with respect to the dispensing channel and has a hollow rod operatively connected to it which telescopically engages the dispensing channel. This hollow rod has a bottom end that engages the closed end of the lower container and also has an opening formed therein adjacent its bottom end to provide communication between the interior of the lower container and the hollow rod. A separator-seal disc is located in the lower container for movement relative to the hollow rod and is positioned to be engaged by the end of the upper container adjacent its open bottom. By this arrangement material contained in both the first and second containers will simultaneously be discharged from the dispensing opening in the upper container upon depression of the upper container into the second container.

11 Claims, 6 Drawing Figures

FIG. 1
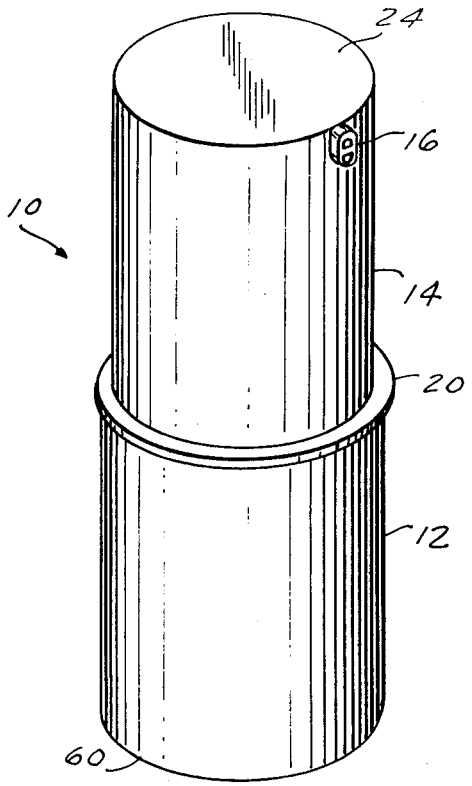
FIG. 2
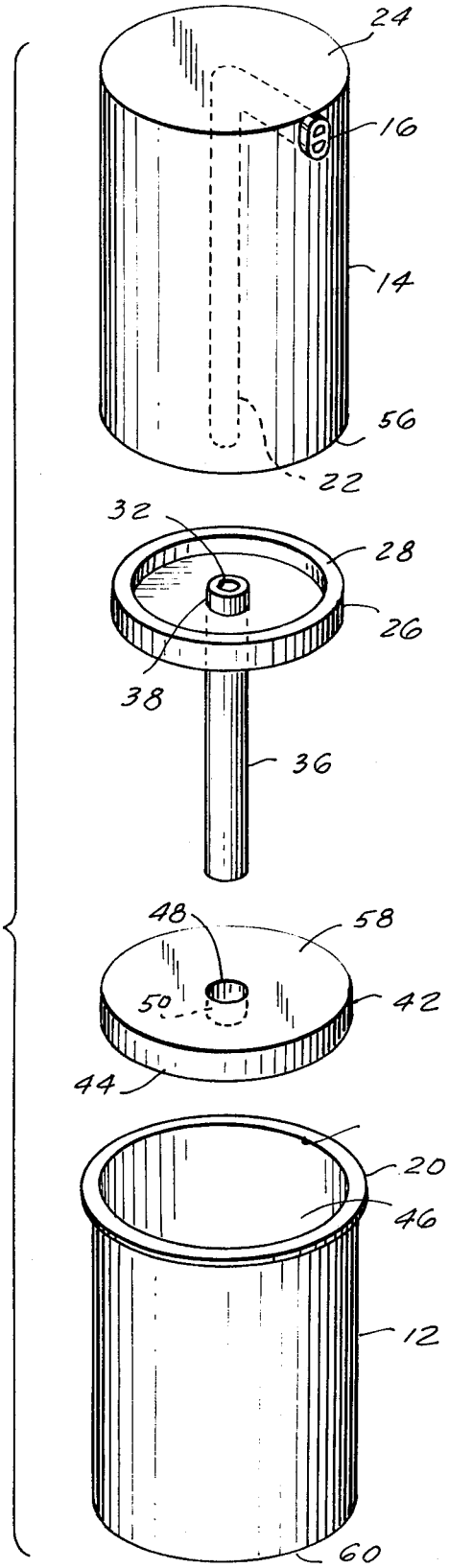
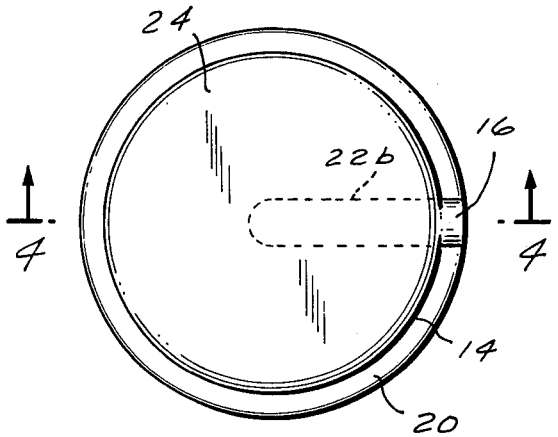
FIG. 3

FIG. 4
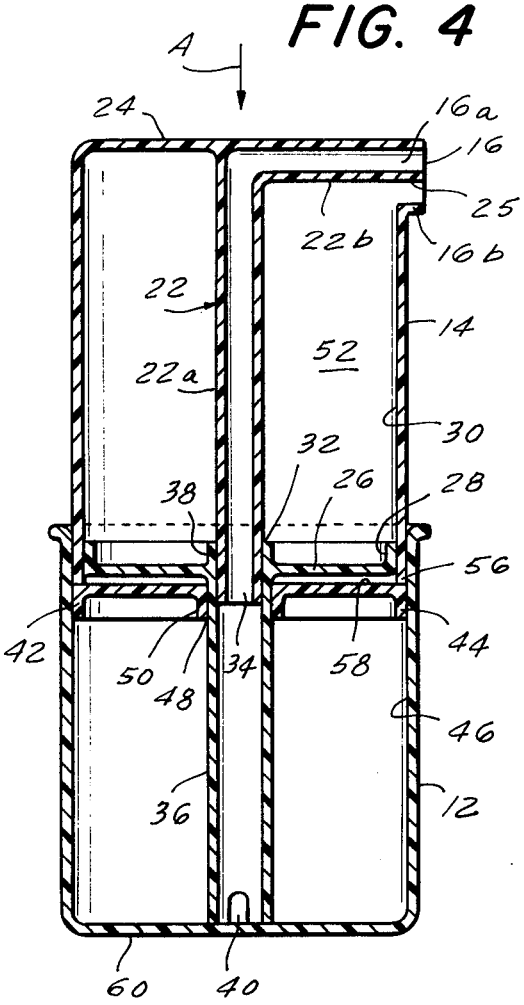
FIG. 5
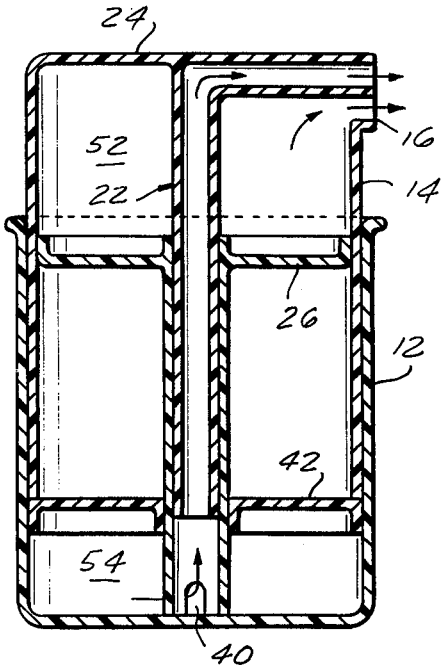
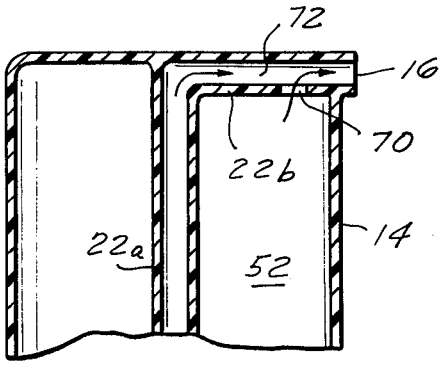
FIG. 6

DISPENSING CONTAINER

The present invention relates to dispensers, and more particularly to a dispenser for flowable materials such as creams, greases and the like.

Cream dispensers have been provided in a variety of forms, such as for example the conventional toothpaste tube or pump type hair cream dispensers. In addition, attempts have been made to provide rigid dispensing containers for creamlike materials in which two container sections are used which, upon squeezing or depressing of one container towards another, will urge cream from the container through a dispensing orifice. Such dispensers usually define separate upper and lower chambers, with only one of those chambers, usually the lower chamber, being filled with the creamlike material. Dispensers of this type are shown for example in U.S. Pat. No. 3,208,645 to Rayner; U.S. Pat. No. 1,264,908 to Drury; and U.S. Pat. No. 2,656,953 to Rich. Such dispensers suffer from the disadvantage that a substantial amount of space within the container when filled is wasted and unavailable for containing the material to be dispensed.

For example, in the Rayner structure the entire upper chamber of the dispenser is unavailable for use in containing or dispensing the product sold in the container. These disadvantages are overcome to a certain extent by receptacles of the type shown in U.S. Pat. No. 2,001,819 which discloses a receptacle for pastes that is adapted to contain the paste in both the upper and lower chamber of the dual container receptacle. However, the Elle container cannot dispense two separate and distinct types of cream materials at the same time as is sometimes required, for example, in the toothpaste industry where it is desirable to provide toothpaste with a striped effect, resulting from the use of two different types, or two differentialy colored, toothpaste components. Likewise, in the adhesive field, it is often necessary to apply two different types of epoxies or adhesive components, in order to make a suitable epoxy adhesive. With the Elle receptacle, it is not possible to simultaneously dispense two such materials at the same time.

Accordingly, it is an object of the present invention to provide a receptacle for creamlike materials which is adapted to contain material to be dispensed in both the upper and lower chambers thereof.

It is another object of the present invention to provide a single dispenser which is adapted to dispense two distinct creamlike materials at the same time.

A further object of the present invention is to provide a dispenser of the character described which is relatively simple in construction and durable in use.

A still further object of the present invention is to provide a dispenser of the character described which is relatively simple and inexpensive to manufacture.

In accordance with an aspect of the present invention the dispenser consists of a first generally cylindrical open topped container and a second, generally cylindrical, open bottom container dimensioned to be telescopically received in the open topped container. The second or upper container has first and second dispensing orifices formed therein with a hollow dispensing tube communicating at one end with the first orifice and having its other end located adjacent to the open bottom of the container. A piston is slidably received in the upper container for sliding movement with respect to the dispensing tube in order to urge material in the upper container out of the second orifice when the piston moves toward the top of the second container. The piston includes a hollow piston rod which is open at both ends and telescopically receives at its upper end the dispensing tube of the upper container. The bottom end of this rod engages the bottom of the lower container and provides communication between the interior of the lower container and the dispensing tube. A separator seal is located in the first container in position to be engaged by the edge of the second container and has an aperture therein slidably receiving the piston rod. By this construction the material contained in the second or upper container between its top and the piston, and material contained in the first or lower container between its bottom and the separator seal disc, will be simultaneously discharged upon depression of the upper container into the lower container.

The above, and other objects, features and advantages of this invention will be apparent from the following detailed description of illustrative embodiments thereof, which are to be read in connection with the accompanying drawings, wherein:

FIG. 1 is a perspective view of a dispensing container constructed in accordance with one embodiment of the present invention;

FIG. 2 is an exploded perspective view of the dispensing container illustrated in FIG. 1;

FIG. 3 is a plan view of the dispensing container of FIG. 1;

FIG. 4 is a longitudinal sectional view of the dispensing container of FIG. 1 when it is filled and ready for use;

FIG. 5 is a sectional view similar to FIG. 4 showing the dispensing container after a period of use in which material from both the upper and lower containers has been dispensed through the dispensing orifice; and FIG. 6 is a partial sectional view similar to FIG. 4 showing another embodiment of the present invention.

Referring now to the drawing in detail, and initially to FIG. 1 thereof, a dispenser 10 is disclosed which consists of a first or bottom container 12 having an open top which telescopically receives a second upper container 14. Each of the containers, as described hereinafter, holds a supply of material to be dispensed, and are arranged so that upon depression of the upper container 14 into the lower container 12, the material from both containers is dispensed through the divided dispensing orifice 16.

As seen in FIG. 2, the generally cylindrical lower container 12 has an open top 18 which is provided with an annular outwardly extending flange 20. The upper container is also of generally cylindrical construction and has an outside diameter which is substantially equal to the inside diameter of lower container 12, so as to be telescopically received therein.

Upper container 14 has a dispensing channel or tube 22 (shown more clearly in FIG. 4) mounted therein, and preferably integrally formed therewith. This tube has a generally L-shaped configuration and is inverted with its long leg **22*a* extending axially of cylindrical container 14 and its shorter leg 22*b* extending radially along the top 24 of the container 12 (See FIG. 3). One end 25 of tube 22 communicates with dispensing opening 16 and effectively divides the opening into two sections 16A and 16B. Upper container 14 receives a piston 26 therein that has an external diameter substantially equal to the internal diameter of lower container 12. As seen in FIGS. 4 and 5, piston 26 has an upwardly extending angular flange 28 formed therein which engages the interior wall 30 of the container 14 to form a seal therebetween while permitting the piston to slide with respect to the container. The piston also has a centrally located opening 32 formed therein which receives the lower end 34 of the leg 22***a* of the L-shaped dispensing channel 22. A piston rod 36 is integrally formed with piston 26 and extends from the central opening 32 away from upper container 14. The length of the hollow piston rod or support stem 36 is selected such that when containers 14 and 12 are nested, as illustrated in FIG. 4, piston 26 is within the lower end of container 14 and upper end of the container 12.

Piston 26 includes an annular flange 38 which surrounds the lower end 34 of the dispensing channel leg 22*a* at the opening 32 in order to form a seal therebetween and to stabilize movement of the piston as it slides with respect to the dispensing channel.

The lower end of the piston rod or support stem 36 has at least one opening 40 formed therein to provide communication between the interior of the piston rod and the interior of container 12 to allow movement of materials into the piston rod and thus to the dispensing channel 22.

The final element of the dispenser 10 consists of a separator seal disc 42. This disc is of substantially the same construction as piston 26, but has a somewhat greater diameter. As seen in FIG. 4 disc 42 has a diameter which is substantially equal to the internal diameter of the container 12. At its periphery the disc has a downwardly extending flange element 44 which engages the internal wall 46 of container 12 to form a seal therewith, while allowing the disc to slide with respect to the interior of the container. Similarly the disc has a centrally located aperture 48 which is surrounded by a downwardly extending annular flange 50. The flange engages the periphery of the piston rod 36 and forms a seal therewith while stabilizing the disc on the piston rod and allowing it to slide with respect to the rod.

In the assembled configuration of the dispensing container as illustrated in FIG. 4, piston 26 forms, in upper container 14, a chamber 52 which is adapted to contain or hold material to be dispensed, such as for example a creamlike material, toothpaste, hair cream, etc. Similarly separator seal disc 42 forms a chamber 54 in the lower container 12. Because of the relative diameters of piston 26 and disc 42, the lower edge 56 of upper container 14 rests on the upper surface 58 of the disc 42, as seen in FIG. 4.

By this arrangement, when a downward force is applied to the upper container 14, as indicated by the arrow A in FIG. 4, the upper container will be urged downwardly into container 12. This downward movement forces disc 42 downwardly, and applies pressure on the material in chamber 54. This pressure urges the material in that chamber through opening 40 in piston rod 36, up the piston rod 36 and dispensing channel 22, to the discharge opening section 16A. Similarly this downward movement causes the upper wall 24 of container 14 to move downwardly with respect to piston rod 26 (which, in effect, is held stationary because of the support provided by its piston rod 36 resting on the base wall 60 of the container 12). This downward relative movement of container 14 relative to piston 26 applies pressure to material contained in chamber 52 and urges it out of the discharge opening section 16B. The relative movement of the elements to one another is illustrated most clearly in FIG. 5 wherein the arrows indicate the flow direction of the material contained in the respective chambers 52, 54.

By this arrangement it is possible to dispense two distinctly different materials at the same time from a single container. This is suitable for use in dispensing a striped type toothpaste, or epoxy materials which are used to form an adhesive, but which must be kept segregated until used.

The container of the invention can be filled in a variety of manners. For example, the container 12 can be filled in its upright position to the desired level, and then the disc 42 placed on top of the material therein. The piston rod 36 can then be inserted through opening 48 of separator seal disc 42 into the material until it engages the bottom wall 60 of container 12. The upper container 14 can be filled in an inverted position, preferably with the dispensing opening 16 closed by a cap (not shown). Once this container section is filled, the lower container 12 can be inverted since its upper end is sealed by the separator disc and the piston, and the two elements telescopically engaged with one another. Because of the relatively tight seals formed by flanges 28, 44 on the piston and disc, the assembled dispensing container is secure against separation.

In another form of the invention where it is not necessary to obtain a stripped effect from the material dispensed from the container, it is possible to eliminate the dispensing opening section 16B, as seen in FIG. 6, and simply provide an opening 70 in the short leg 22*b* of the dispensing channel or tube 22. In this arrangement the material from chamber 52 will simply flow through opening 70 into the dispensing channel bore 72 of the short leg 22*b* of the channel, for discharge through orifice 16 with the material flowing up the channel 22 from the chamber 54.

Accordingly, it will be appreciated that a relatively simply constructed an inexpensively manufactured dispensing container is provided which has substantial advantages over the devices of the prior art. In particular, it enables a manufacturer to supply two discretely different materials in a single container while enabling those materials to be simultaneously dispensed.

Although illustrative embodiments of the present invention have been described herein with reference to the accompanying drawings, it is to be understood that various changes and modifications may be effected therein by those skilled in the art, without departing from the scope or spirit of this invention.

What is claimed is:

1. A dispenser for flowable materials comprising a first, open-topped container, a second open-bottomed container dimensioned to be telescopically received in said open topped container with its open bottom therein, said open-bottomed container having a dispensing orifice formed therein and containing a hollow dispensing channel communicating at one end with at least a portion of said orifice and having its other end located adjacent the open bottom of said second container; a piston received in said second container for sliding movement therein with respect to said dispensing channel; a hollow rod operatively connected to said piston and telescopically engaging and receiving said dispensing channel, said hollow rod having a bottom end engaging the bottom of said first container and having an opening therein providing communication between the interior of said first container, said hollow rod and said dispensing channel and a separator-seal member located in said first container for movement relative to said rod and in position to be engaged by the edge of said second container surrounding the open bottom thereof, whereby material contained in said first and second containers will be simultaneously discharged upon depression of the first container into the second container.

2. The dispenser is defined in claim 1 wherein said dispensing channel comprises a generally L-shaped tube having its long leg centrally located in the second container.

3. The dispenser as defined in claim 2 wherein said tube is integrally formed with said second container.

4. The dispenser as defined in claim 1 wherein said dispensing channel communicates with the entire orifice in said second container and has an aperture formed therein for reviewing material from said second container for discharge through said orifice.

5. The dispenser as defined in claim 1 wherein said piston has a sealing flange extending perpendicularly therefrom for engaging the inner walls of said second container and forming a seal therewith.

6. The dispenser as defined in claim 1 wherein said separator-seal has a sealing flange extending perpendicularly therefrom for engaging the inner walls of said first container and forming a seal therewith.

7. A dispenser for flowable materials comprising a first, generally cylindrical, open-topped container; a second generally cylindrical open-bottomed container dimensioned to be telescopically received in said open-topped container with its open bottom therein; said second container having first and second dispensing orifices formed therein; a hollow dispensing tube in said second container communicating at one end with said first orifice and having its other end located adjacent the open bottom of said second container, said tube having a portion thereof extending generally axially of said second container; a piston slidably received in said second container for sliding movement with respect to said dispensing tube for urging material in said second container out of said second orifice when the piston moves towards the top of the second container; said piston including a hollow piston rod axially located in said first container and being open at both ends, said piston rod beig dimensioned to telescopically receive said dispensing tube through said piston and having an open bottom end engaging the bottom of said first container for providing communication between the interior of said first container and said dispensing tube; and a separator-seal disc located in said first container in position to be engaged by the edge of the second container and having an aperture therein slidably receiving said piston rod; whereby material contained in said second container between its top and said piston, and material contained in said first container between its bottom and said separator-seal disc will be simultaneously and respectively discharged through said first and second dispensing orifice upon depression of the first container into the second container.

8. A dispenser as defined in claim 7 wherein said dispensing tube is generally L-shaped with its long leg located axially of said second container and its short leg extending along the top of the second container to said first discharge orifice.

9. A dispenser as defined in claim 8 wherein said tube is integrally formed with said second container.

10. The dispenser as defined in claim 8 wherein said piston has a sealing flange extending perpendicularly therefrom for engaging the inner walls of said second container and forming a seal therewith.

11. The dispenser as defined in claim 10 wherein said separator-seal disc has a pair of concentric flanges formed thereon respectively located around the edge of the separator-seal disc and the aperture therein for respectively sealing by energy the inner wall of said bottom container and said piston rod to form a seal therewith.

* * * * *